US005205695A

United States Patent [19]

Katsui

[11] Patent Number: 5,205,695

[45] Date of Patent: Apr. 27, 1993

[54] REFUSE STORAGE EQUIPMENT

[75] Inventor: Seizo Katsui, Osaka, Japan

[73] Assignee: Kabushiki Kaisha Plantec, Osaka, Japan

[21] Appl. No.: 833,586

[22] Filed: Feb. 12, 1992

Related U.S. Application Data

[63] Continuation of Ser. No. 541,855, Jun. 21, 1990, abandoned.

[30] Foreign Application Priority Data

Jun. 22, 1989 [JP] Japan ..... 1-73218[U]

[51] Int. Cl.[5] ..... F23K 5/00

[52] U.S. Cl. ..... 414/196; 222/64; 222/129; 414/289

[58] Field of Search ..... 414/289, 327, 148, 161, 414/187, 196, 216, 221; 222/64, 129, 556, 559, 561; 251/62, 63, 63.5

[56] References Cited

U.S. PATENT DOCUMENTS

| | | | |
|---|---|---|---|
| 955,606 | 4/1910 | Moreau | 414/221 |
| 960,857 | 6/1910 | Eggert | 414/221 |
| 1,542,380 | 6/1925 | Foster | 414/289 X |
| 2,111,915 | 3/1938 | MacMillin | 222/561 X |
| 2,515,137 | 7/1950 | Schall et al. | 222/561 X |
| 2,708,040 | 5/1955 | Somogyi | 414/221 X |
| 2,915,205 | 12/1959 | Strader | 414/289 |
| 3,315,824 | 4/1967 | Kirchhoefer | 414/221 |
| 3,933,103 | 1/1976 | Mikkelsen | 414/216 X |
| 4,026,427 | 5/1977 | Greaves et al. | 414/161 |
| 4,222,498 | 9/1980 | Brock | 222/58 |
| 4,231,478 | 11/1980 | Stone | 222/58 X |
| 4,312,279 | 1/1982 | Wilson et al. | 414/187 X |
| 4,337,878 | 7/1982 | Brock | 222/58 X |
| 4,669,634 | 6/1987 | Leroux | 222/58 X |

FOREIGN PATENT DOCUMENTS

| | | | |
|---|---|---|---|
| 2459979 | 7/1975 | Fed. Rep. of Germany | 414/221 |
| 568146 | 3/1945 | United Kingdom | 414/289 |

*Primary Examiner*—David A. Bucci
*Attorney, Agent, or Firm*—Armstrong, Westerman, Hattori, McLeland & Naughton

[57] ABSTRACT

A refuse storage equipment for temporary storage and timely discharge of refuse which includes a storage tank having a refuse charging hopper at its top and a refuse discharge port at its bottom and a plurality of dampers adapted to divide the space within the storage tank into a plurality of storage compartments, the dampers being sequentially actuated beginning with the uppermost one to allow the refuse to fall from the uppermost to the lowermost of each storage compartment and discharged from the refuse discharge port in sequence.

8 Claims, 2 Drawing Sheets

REFUSE STORAGE EQUIPMENT

This application is a continuation of application Ser. No. 07/541,855 filed Jun. 21, 1990 now abandoned.

BACKGROUND OF THE INVENTION

The present invention relates to a refuse storage equipment for temporary storage and timely discharge of general refuse or industrial wastes and, more particularly to a refuse storage tank suitable for medical waste intermingled with general and industrial wastes.

BRIEF DESCRIPTION OF THE PRIOR ART

The hitherto-known storage equipment of this type on a comparatively small scale comprises a tank body and, as disposed at the bottom thereof, a turntable, a screw conveyer or a scraper conveyer which, on actuation, discharges the refuse storaged in the tank body. The large-scale equipment of the prior art is a pit-and-crane system in which the refuse pooled in a pit is transferred to an incinerator by means of a crane.

However, when the small-scale equipment mentioned above is used, the refuse bags are readily broken during storage or during transfer to an incinerator and the consequent scattering of dirty wastes and leak-out of fouled water contaminate the tank and transfer equipment to bring a sanitary problem. This is particularly true with medical waste containing substances which are infective, injurious or liable to cause environmental pollutions. Because these substances are generally contained in vinyl bags, cartons or corrugated-board boxes, it is necessary to prevent the aforesaid contamination by minimizing the destruction of refuse packages prior to charging into the incinerator.

The prior art equipment including a turntable, screw conveyer or scraper conveyer is generally so complicated in construction that in the event of a mechanical trouble the refuse pooled in the tank must be manually removed to have access to the delivery mechanism located underneath and this entails much labor and time.

Furthermore, in the case of refuses which vary widely in composition, particularly medical waste including wastes of high colorific value such as plastic and cotton products, etc., hardly combustible materials such as paper diapers, excised organs, etc. and non-combustible materials such as metal and glass instruments and were, they cannot be burnt in a stable combustion state if charged into the incinerator without mixing. Thus, such refuses cannot be completely burnt for sterilization and environmental pollution control.

SUMMARY OF THE INVENTION

It is an object of the present invention to overcome the above-mentioned disadvantages of the prior art refuse storage equipment and provide improved refuse storage equipment wherein the refuse is discharged under its own weight without being subjected to undue mixing, tearing or compression and hence with a minimum of contamination of the tank and surroundings and involving a reduced risk of environmental pollution and injury to personnel.

It is a further object of the invention to provide refuse storage equipment which is simple in construction and less liable to develop a fault or failure, can be easily maintained and repaired and ensures facilitated discharge of the refuse.

It is still another object of the invention to provide refuse storage equipment comprising a delivery system installed under a discharge port of the tank body wherein the speed of this delivery system and the timing of actuation of dampers are controlled in correlation to ensure a continuous transport of the refuse to an incinerator to thereby suppress any sudden change in the state of combustion and attempt stabilizing the state of combustion in the incinerator.

In the following description, the following are discussed which are known in the prior art: charging means for charging the hoppers, control means for controlling the sequential operation of the dampers and for correlating the level sensors and the charging means, the control means also controlling the sequential operation of the dampers and also correlating opening and closing of the dampers with the conveyor speed. For example, in U.S. Pat. No. 4,222,498, an apparatus for measuring out aggregate material is shown, constituting an aggregate delivery system. The system includes a plurality of cold feed bins arranged in a row on a frame, each bin being supported on a load cell for measuring weight. Belt feeders are disposed below each of the bins, a single belt conveyor being disposed below the belt feeders. A control circuit is connected to receive the load cell information from each of the bins and then separately controls the belt feeders disposed below each of the bins to adjust the rate at which material is supplied to the single belt conveyor disposed below the belt feeders.

Furthermore, in U.S. Pat. No. 4,337,878, a control circuit which controls a gate is shown, as well as a means for regulating flow of material into a surge bin. This is considered to correspond to the control means, driving unit for driving the dampers, and the charging means shown schematically in FIG. 1. In this patent, a method of weighing and dispensing material from a surge bin is shown. The surge bin is supported on load cells for measuring weight in the surge bin. The load cells are connected to a control circuit which actuates a gate in the bottom of the surge bin to dispense. The control circuit also operates a door in a batcher above the surge bin to regulate the flow of material into the surge bin.

An apparatus for metering quantities of at least one product is shown in U.S. Pat. No. 4,669,634. This patent includes use of a computer for monitoring and controlling a plurality of vertically-arranged structures including means for storage, weighing, metering, and transfer of a product.

DETAILED DESCRIPTION OF THE PREFERRED EMBODIMENTS

Figure 1:
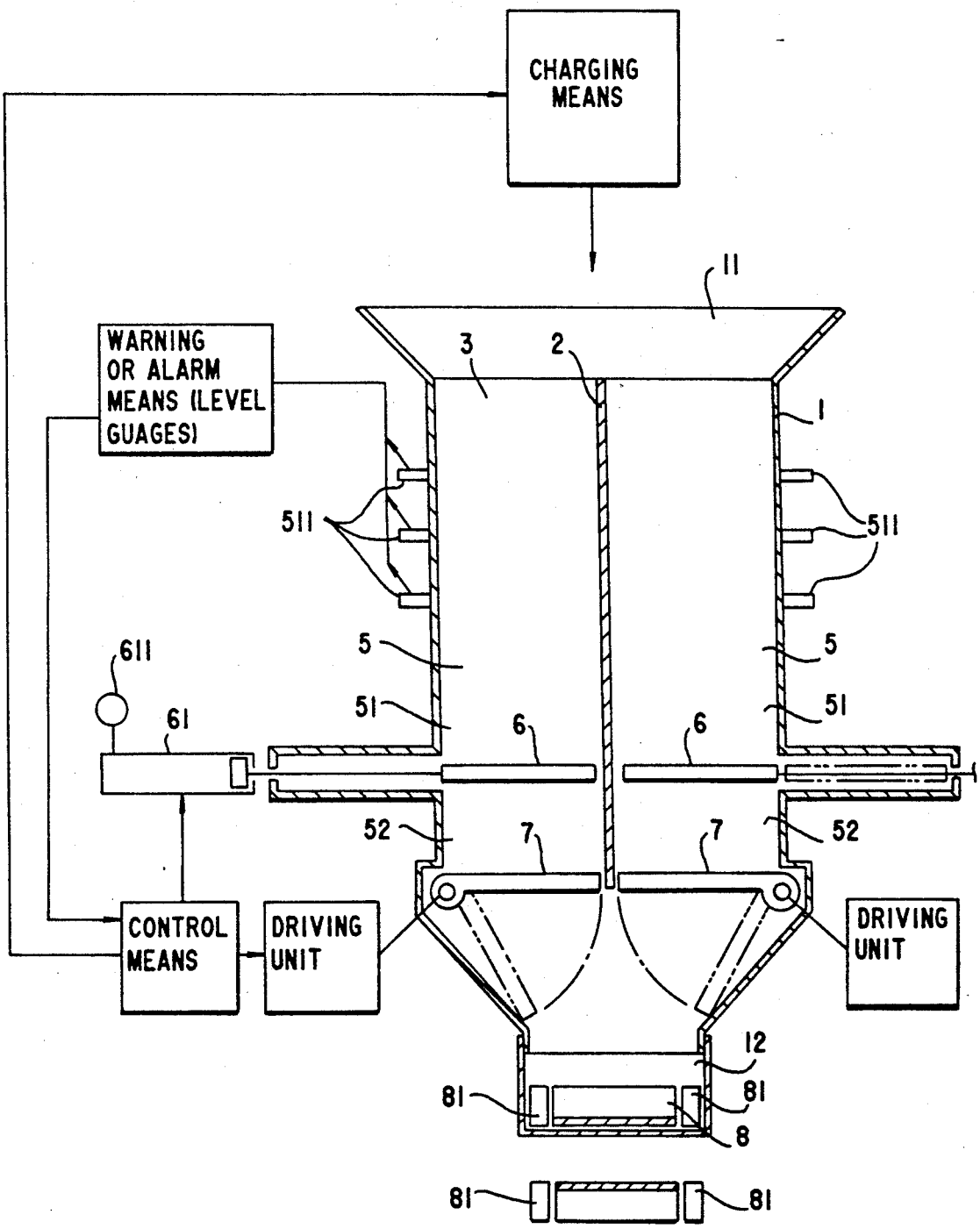
FIG. 1 is a schematic front sectional view illustrating the construction of the refuse storage equipment of the invention.
Figure 2:
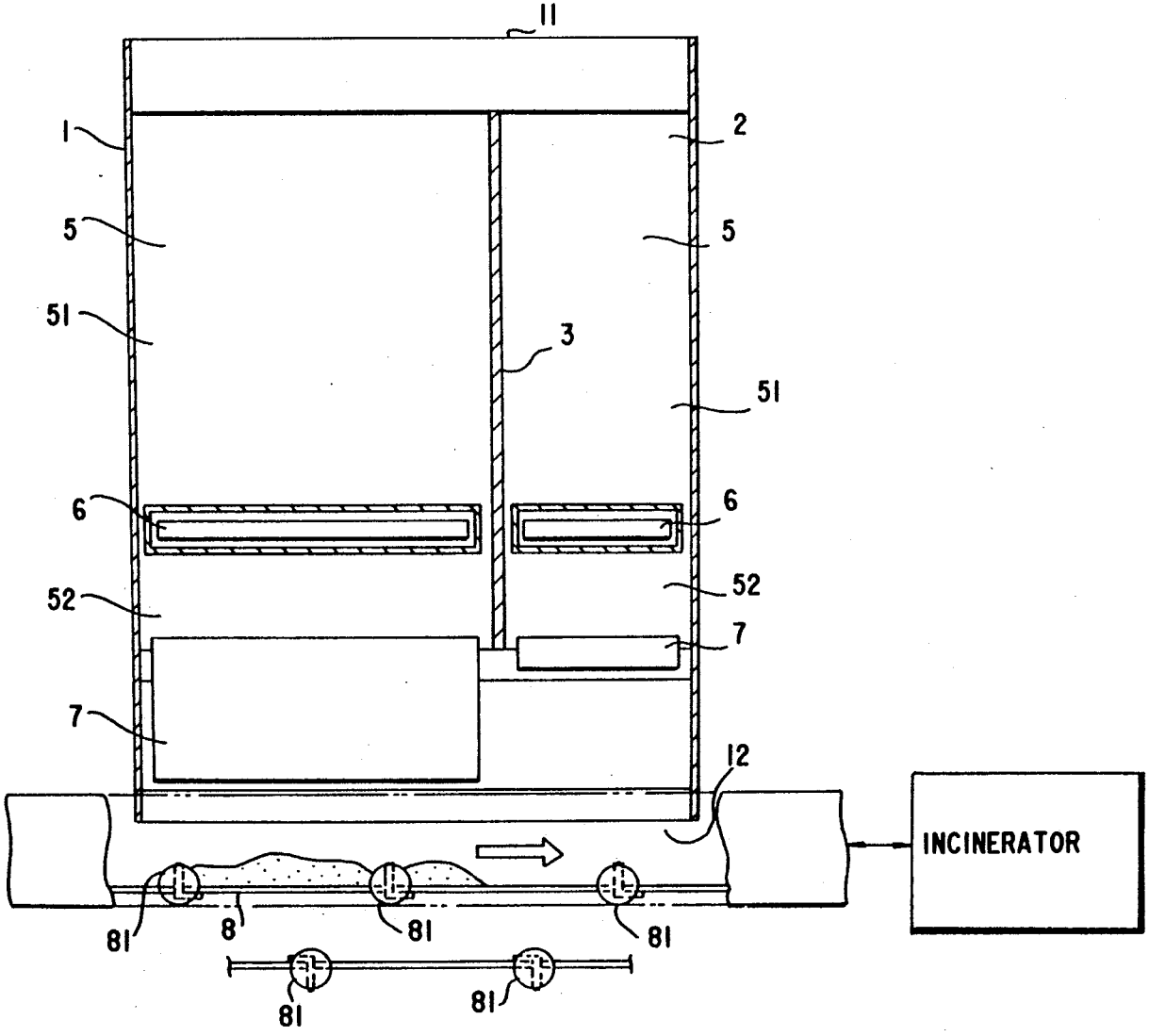
FIG. 2 is a sectional side elevation view showing the construction of the refuse storage equipment according to the invention.

The refuse storage equipment of the present invention is illustrated in FIGS. 1 and 2. Referring to FIGS. 1 and 2, the reference numeral 1 represents a storage tank having a charging hopper 11 and a discharge port 12. The internal space of the tank 1 is divided by a vertical longitudinal partitioning plate 2 and a vertical transverse partitioning plate 3 into four storage chambers 5. Disposed below each of these storage chambers is a double damper means consisting of an upper damper 6 and a lower damper 7. Thus, the upper damper 6 and the lower damper 7 divide an upper storage compartment 51 and a lower storage compartment 52 within the storage chamber 5.

The upper damper 6 is disposed to be movable transversely in horizontal direction by driving unit 61. The upper damper 6 is normally projecting into the corresponding storage chamber 5 to close the chamber 5. As the storage chamber 5 is thus closed by the upper damper 6, the refuse dumped from the charging hopper 11 is piled up in the storage compartment 51.

The aforementioned driving unit 61 is provided with a pressure gauge 611. This pressure gauge measures the reaction of the upper damper 6 against the refuse while the upper damper 6 is caused to project into the storage chamber 5. The driving unit 61 is constructed so that it stops the projecting motion of the upper damper 6 when the reading of the pressure gauge 611 exceeds a predetermined value. By stopping the projecting motion of the upper damper 6 in this manner, the breakage of refuse packages can be minimized. In order to prevent the refuse from falling down, the upper damper 6 need not completely close the storage chamber 5. Rather, it is sufficient to stop the projecting motion of the upper damper 6 with a pressure not so great as crushes the refuse packages.

The lower damper 7 is rotable by a driving unit (schematically shown in FIG. 1), to selectively assume a horizontal position or an inclined position as indicated by the two locations shown in dot chain lines. The lower damper 7 closes the bottom of the storage chamber 5 when it is held in the horizontal position and the refuse falling down upon opening of the upper damper 6 piles up in the lower storage compartment 52.

The upper storage compartment 51 of each storage chamber 5 is provided with a plurality of level gauges 511. These level gauges 511 are adapted to sense the amount of refuse accumulated in the respective upper storage compartments 51 to provide information which can be used for monitoring the charging and discharging statuses of the refuse storage equipment. Based on the information provided by these level gauges 511, it is possible to actuate a warning or alarm means (schematically shown in FIG. 1) and thereby control the charging of refuse.

Disposed under the discharge port 12 of the storage tank 1 is a conveyance system 8. The conveyance system is intended to transport the refuse discharged from the discharge port 12 of the storage tank 1 to an incinerator which is schematically shown in FIG. 2, with the conveyance path ending close to the charging hopper of the incinerator.

The reference numeral 81, in FIGS. 1 and 2, represents guide rollers provided on the conveyance system 8 for smooth driving of the system 8.

The operation of the above refuse storage equipment is explained below.

Referring to FIG. 1, each of the upper dampers 6 is set in a projecting position and each of the lower dampers 7 in a horizontal position to close the storage chambers. As the storage chambers 5 are charged with refuse from the charging hopper 11 in the above condition, the refuse is accumulated in the upper storage compartments 51 of the storage chambers 5. As the upper damper 6 is retracted from the corresponding storage chamber 5, the lower part of the refuse accumulated in the upper storage compartment 51 falls onto the lower damper 7 and is piled up in the lower storage compartment 52. Then, as the upper damper 6 is caused to project into the storage chamber 5, the refuse in the storage chamber 5 is distributed into the upper storage compartment 51 and the lower storage compartment 52. In this condition, the lower damper 7 is swung into the inclined position. Then, the refuse in the lower storage compartment 52 falls through the discharge port 12 onto the conveyance system 8 and is thence carried thereby to the incinerator. Thus, after discharge of the refuse, the lower damper 7 is swung back into the horizontal position and the upper damper 6 is opened as described above, whereupon further refuse is piled up in the lower storage compartment 52.

Since the refuse is discharged under its own weight in this invention, there occurs no forced mixing, tearing or compressive breakage of refuse packages. Consequently, the refuse packages are scarcely destroyed and consequently the fouling of the interior of the storage tank 1 and around the discharge port 12 is minimized. This is not only desirable from a sanitation point of view but is conductive to a reduced risk of pollution and injury to the personnel. Particularly when medical refuse is involved, the infection of personnel due to contaminant bacteria and the like can be effectively prevented.

Furthermore, while the refuse is intermittently discharged onto the conveyance system 8 according to operation of the upper dampers 6 and lower dampers 7, it is possible to effect a continuous and average charging of the incinerator with the refuse by a control means (schematically shown in FIG. 1) controlling the timing of discharge from the lower damper 7 and the travelling speed of the conveyance system in any desired correlation and thereby ensure a stabilized combustion of refuse in the incinerator.

Furthermore, the refuse may be selectively stored in the plurality of storage compartments 5 according to its type or composition and by discharging different kinds of refuse from the respective storage compartments 5 in a suitable combination, it is possible to effect the uniformity of quality of the refuse to be fed to the incinerator and thereby suppress any violent fluctuation in the state of combustion for a further improvement of operation.

While, in this embodiment, the interior of the storage tank 1 is divided by the vertical longitudinal partitioning plate 2 and vertical transverse partitioning plate 3 into four storage chambers, the storage tank space may be divided into any other suitable number of chambers. For example, when the capacity of the storage tank is small or the variation in refuse composition is small, the interior of the storage tank need not be divided. Moreover, the mode of operation of the upper damper 6 and the lower damper 7 may each be whichever of the horizontal shift type and vertical swing type described hereinbefore.

What is claimed is:

1. A medical refuse storage apparatus for temporary storage and timely discharge of medical refuse intermingled general refuse and industrial waste comprising:

a storage tank having a refuse charging hopper at its top and a refuse discharge port at its bottom;

an upper damper movable in a horizontal direction for partitioning an interior space within said storage tank into two storage compartments, an upper storage compartment and a lower storage compartment, when closed;

a lower damper disposed vertically swingable in a bottom of said interior space for individually opening and closing said refuse discharge port;

upper damper actuating means for actuating said upper damper between an open position and a closed position;

lower damper actuating means for actuating said lower damper between an open position and a closed position;

a pressure gauge, for measuring a reaction of said upper damper against the refuse during said upper damper closing, being disposed in the upper damper actuating means;

a conveyance system disposed under said refuse discharge port of said storage tank for transporting the refuse discharged from said refuse discharge port away from said storage tank;

control means for adjusting the conveying speed of said conveyance system and the opening and closing timing of said dampers; and wherein the upper and lower dampers are sequentially opened and closed to fall the refuse once into said lower storage compartment from the upper storage compartment, then the refuse is discharged from said refuse discharge port, while the refuse is continuously conveyed into an incinerator by adjusting the conveying speed of said conveyance system and opening and closing timing of said dampers by said control means, and the closing action of said upper damper is stopped when the measurement by said pressure gauge exceeds a preset pressure during the closing action of said upper damper so that refuse packages packed with the medical refuse may not be broken by said upper damper.

2. A medical refuse storage apparatus of claim 1 wherein said upper storage compartment further comprises a plurality of level gauges for sensing an amount of storage of refuse in said upper storage compartment, so as to permit monitoring a status of storage of refuse.

3. A medical refuse storage apparatus of claim 2 wherein an alarm means is actuated according to information provided by any of said level gauges.

4. A medical refuse storage apparatus of claim 2 wherein a charging amount of refuse is controllable according to an amount of storage of refuse as sensed by any of said level gauges.

5. A medical refuse storage apparatus for temporary storage and timely discharge of medical refuse intermingled general refuse and industrial waste comprising:

a storage tank having a refuse charging hopper at its top and a refuse discharge port at its bottom, with an interior space partitioned vertically into a plurality of chambers mutually differing in volume by a vertical partition;

a plurality of upper damper movable in a horizontal direction for dividing each chamber into two storage compartments, an upper storage compartment and a lower storage compartment, when closed;

a plurality of lower damper disposed vertically swingable in a bottom of each chamber for individually opening and closing the refuse discharge ports of each chamber;

upper damper actuating means for selectively actuating said upper damper between an open position and a closed position;

lower damper actuating means for selectively actuating said lower damper between an open position and a closed position;

a pressure gauge for measuring a reaction of said upper damper against the refuse during said upper damper closes, being disposed in the upper damper actuating means;

a conveyance system disposed under said refuse discharge port of said storage tank for transporting the refuse discharged from said refuse discharge port away from said storage tank;

control means for adjusting the conveying speed of said conveyance system and the opening and closing timing of said dampers; and wherein the upper and lower dampers are sequentially opened and closed to fall the refuse once into said lower storage compartment, then the refuse is discharged from said refuse discharge port, while the refuse is continuously conveyed into an incinerator by adjusting the conveying speed of said conveyance system and opening and closing timing of said dampers by said control means, and the closing action for said upper damper is stopped when the measurement by said pressure gauge exceeds a preset pressure during the closing action of said upper damper so that refuse packages packed with the medical refuse may not be broken by said upper damper;

6. A medical refuse storage apparatus of claim 5 wherein said upper storage compartment further comprises a plurality of level gauges for sensing an amount of storage of refuse in said upper storage compartment, so as to permit monitoring a status of storage of refuse.

7. A medical refuse storage apparatus of claim 6 wherein an alarm means is actuated according to information provided by any of said level gauges.

8. A medical refuse storage apparatus of claim 6 wherein a charging amount of refuse is controllable according to an amount of storage of refuse as sensed by any of said level gauges.

* * * * *